United States Patent [19]

Eckert et al.

[11] Patent Number: 4,559,443

[45] Date of Patent: Dec. 17, 1985

[54] INITIALIZING THE PRINT WHEELS IN AN ELECTRONIC POSTAGE METER

[75] Inventors: Alton B. Eckert, Norwalk, Conn.; Easwaran C. N. Nambudiri, Hicksville, N.Y.

[73] Assignee: Pitney Bowes Inc., Stamford, Conn.

[21] Appl. No.: 695,027

[22] Filed: Jan. 28, 1985

Related U.S. Application Data

[63] Continuation-in-part of Ser. No. 447,913, Dec. 8, 1982, abandoned.

[51] Int. Cl.[4] ..... G07G 1/00

[52] U.S. Cl. ..... 235/101; 400/704; 29/434

[58] Field of Search ..... 235/101; 364/464, 900; 400/704; 101/DIG. 12; 29/407, 434

[56] References Cited

U.S. PATENT DOCUMENTS 3,949,203 4/1976 Majavazos et al. ..... 235/101

4,251,874 2/1981 Check, Jr. ..... 364/900

4,301,507 11/1981 Soderberg et al. ..... 364/464

FOREIGN PATENT DOCUMENTS 0019515 11/1980 European Pat. Off. .

*Primary Examiner*—Benjamin R. Fuller

*Attorney, Agent, or Firm*—Joseph A. Sawyer, Jr.; William D. Soltow, Jr.; Albert W. Scribner

[57] ABSTRACT

Method and apparatus for initializing the printwheels in an electronic postage meter is disclosed. The apparatus comprises a printwheel selection mechanism which is comprised of various components. The various components on the printwheel selection mechanism are adjusted to set a plurality of printwheels to a predetermined position. After those printwheels are adjusted a signal is produced which indicates that the printwheels are located at that predetermined position. The various components of the printwheel selection mechanism are sequentially adjusted to set the printwheels so that the postage meter settings are at a known initial point.

32 Claims, 12 Drawing Figures

OPTO
SERIAL I/O CHANNEL
90
SYSTEM CLOCK
92
POWER ON RESET
72
LOW VOLTAGE SENSOR
88
NVM READY
CPU WAIT
TP
CPU
10a
ADDRESS BUS
94
DATA BUS
108
CONTROL BUS
96
DEVICE SELECT
98
RAM I/O TIMER
16a
SELECT LINES
99
NVM V5 SW
V4
V5
82
V5 SWITCH
76
AC LINE
HOT SW MDV
50
FUSE
58
TRANSFORMER
56
V4 REG.
70
V5 REG.
74
OPTO TRIAC
54
COLD SWITCH
60
SWITCHER
62
V2 FILTER
66
AC DRIVE MOTOR
36a
V2 DISPLAY
V2 LOGIC
48
RFI FILTER
52
PREREGULATOR
59
V1

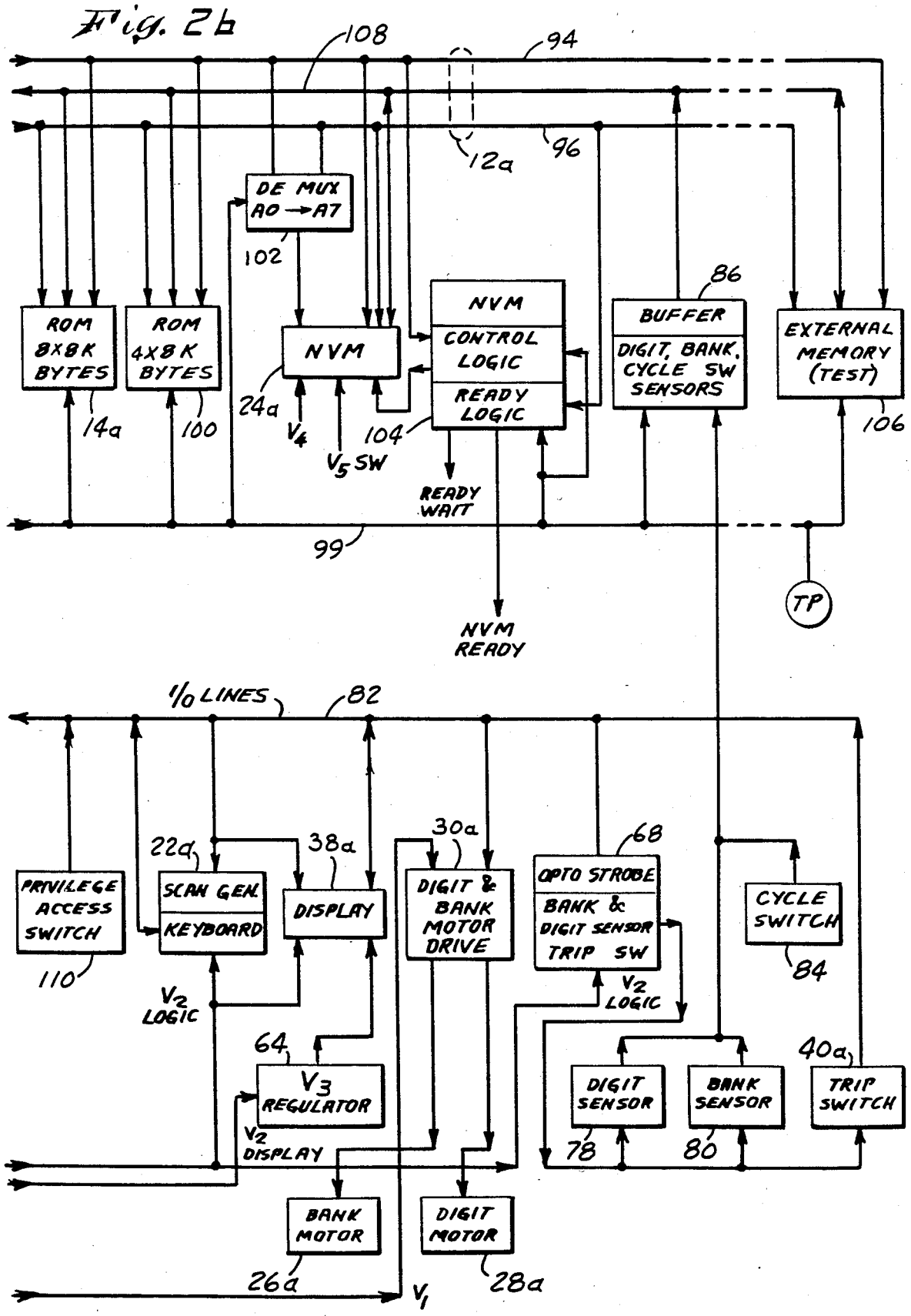
Fig. 2b
108
94
96
12a
DE MUX
A0 → A7
102
ROM
8X8K
BYTES
14a
ROM
4X8K
BYTES
100
NVM
24a
V4
V5 SW
NVM
CONTROL
LOGIC
READY
LOGIC
104
READY
WAIT
BUFFER
DIGIT, BANK,
CYCLE SW
SENSORS
86
EXTERNAL
MEMORY
(TEST)
106
99
TP
NVM
READY
I/O LINES
82
PRIVILEGE
ACCESS
SWITCH
110
22a
SCAN GEN.
KEYBOARD
38a
DISPLAY
30a
DIGIT &
BANK
MOTOR
DRIVE
68
OPTO STROBE
BANK &
DIGIT SENSOR
TRIP SW
CYCLE
SWITCH
84
V2
LOGIC
V2
LOGIC
64
V3
REGULATOR
V2
DISPLAY
DIGIT
SENSOR
78
BANK
SENSOR
80
40a
TRIP
SWITCH
BANK
MOTOR
26a
DIGIT
MOTOR
28a
V1

INITIALIZING THE PRINT WHEELS IN AN ELECTRONIC POSTAGE METER

CROSS REFERENCE TO RELATED APPLICATIONS

The present application is related to copending patent application Ser. No. 447,815, filed on Dec. 8, 1982 in the names of Danilo Buan and Alton B. Eckert, entitled, STAND-ALONE ELECTRONIC MAILING MACHINE, the disclosure of which is incorporated herein by reference. This application is a continuation-in-part of U.S. Application Ser. No. 447,913 filed on Dec. 8, 1982 now abandoned.

BACKGROUND OF THE INVENTION

The present invention relates to electronic postage meters and more particularly to electronic postage meters of the stand-alone type such as disclosed in the aforementioned copending application Ser. No. 447,815, filed Dec. 8, 1982 herewith in the names of Danilo Buan and Alton B. Eckert and entitled, STAND-ALONE ELECTRONIC MAILING MACHINE.

Known electronic postage meters have generally comprised two separate units like their earlier mechanical forerunners i.e., a postage meter and base or mailing machine to enable the postage meter to be physically taken to the post office periodically to charge the meter. Such a meter is disclosed in U.S. Pat. No. 4,301,507 issued on Nov. 17, 1981 and assigned to Pitney-Bowes, Inc. of Stamford, Conn. With the advent of remote meter resetting systems, it is no longer necessary that the postage meter be separated into two distinct units since the necessity to take the meter to the post office for recharging has been eliminated. Further, it is desirable to have a self-contained electronic postage meter that includes the metering function as well as all drive mechanisms to reduce the size and weight of the meter as well as making it more economical to produce. The mechanical construction of such a meter is disclosed in the aforementioned patent application. U.S. Pat. No. 4,251,874, issued on Feb. 17, 1979 in the name of Frank T. Check, Jr., entitled, ELECTRONIC POSTAGE METER SYSTEM, and assigned to Pitney Bowes, Inc., of Stamford, Conn., discloses a system for keeping track of the number of errors present during meter operation.

In programmable electronic postage meters, it is important during initial power up, after power failure, or after unforeseen binding of the meter components to relocate the print wheels to a known position for the subsequent setting of postage.

SUMMARY OF THE INVENTION

In an ilustrative embodiment, a method and associated apparatus is provided for initializing the printwheels in an electronic postage meter. The apparatus comprises principally a printwheel selection mechanism. The printwheel selection mechanism comprising the carriage assembly including motor means, gear means and a carriage. The printwheel selection mechanism also including racks and associated gear and motor assembly and a shaft means for selecting a position of the rack members.

The method for initializing the printwheels in an electronic postage meter utilizes the components of the printwheel selection mechanism in the below described manner:

Initially the shaft means of the printwheel selection mechanism is placed in its select position. Then the carriage is moved into abutment with framework of the postal mailing machine a plurality of times. Thereafter, the carriage is aligned with the racks of the printwheel selection mechanism. Thereafter, the racks through associated gears and motors is oriented with one of the printwheels of the postal mailing system. Thereafter, the racks in turn rotate the printwheel into abutment with a stop a plurality of times. The printwheel is then aligned and thereafter exercised to be set at a predetermined position. The above mentioned steps will thereby initialize a first printwheel. The above mentioned steps are continued sequentially with each printwheel to set all the printwheels to a predetermined position. Thereafter, a signal is outputted indicating that all the printwheels have been accomplished. Another feature of this embodiment is that the force by which the components of the printwheel selection mechanism or the printwheel is moved into abutment with a stop may be increased as desired.

Other objects, aspects and advantages of the present invention will be apparent when the detailed description is considered with the embodiment of the invention illustrated in the drawings as follows.

Figure 3:
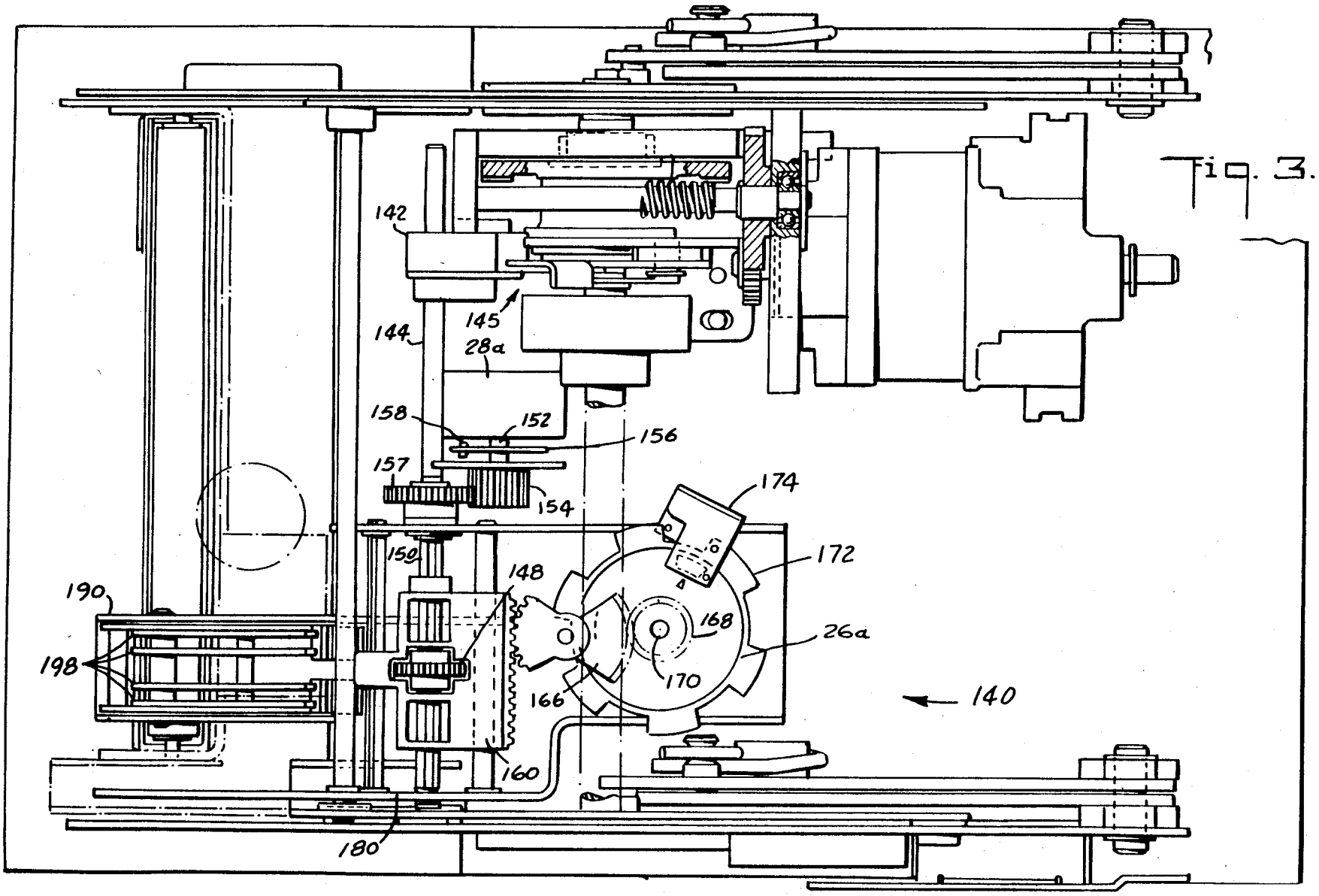
Figure 4:
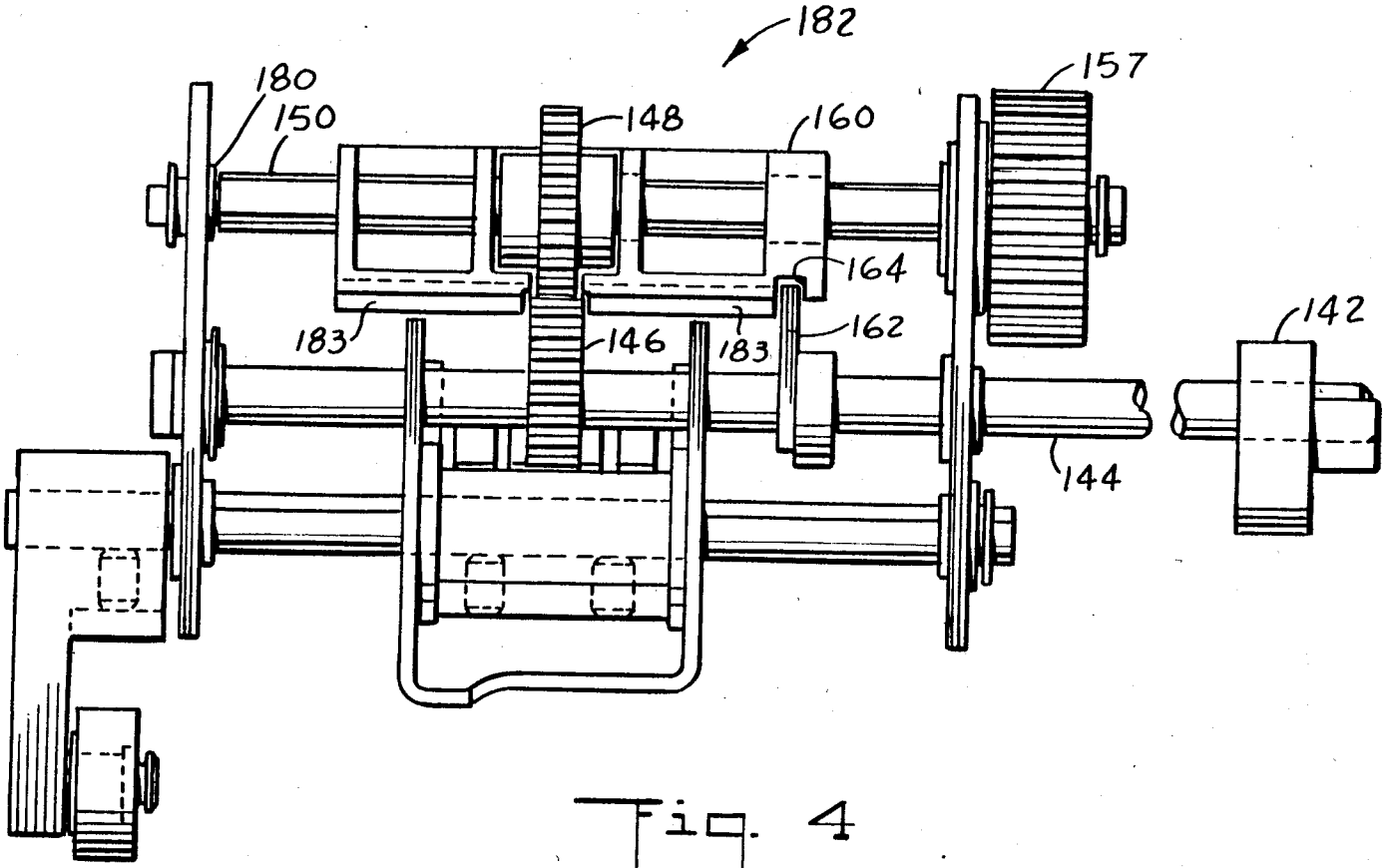
Figure 5:
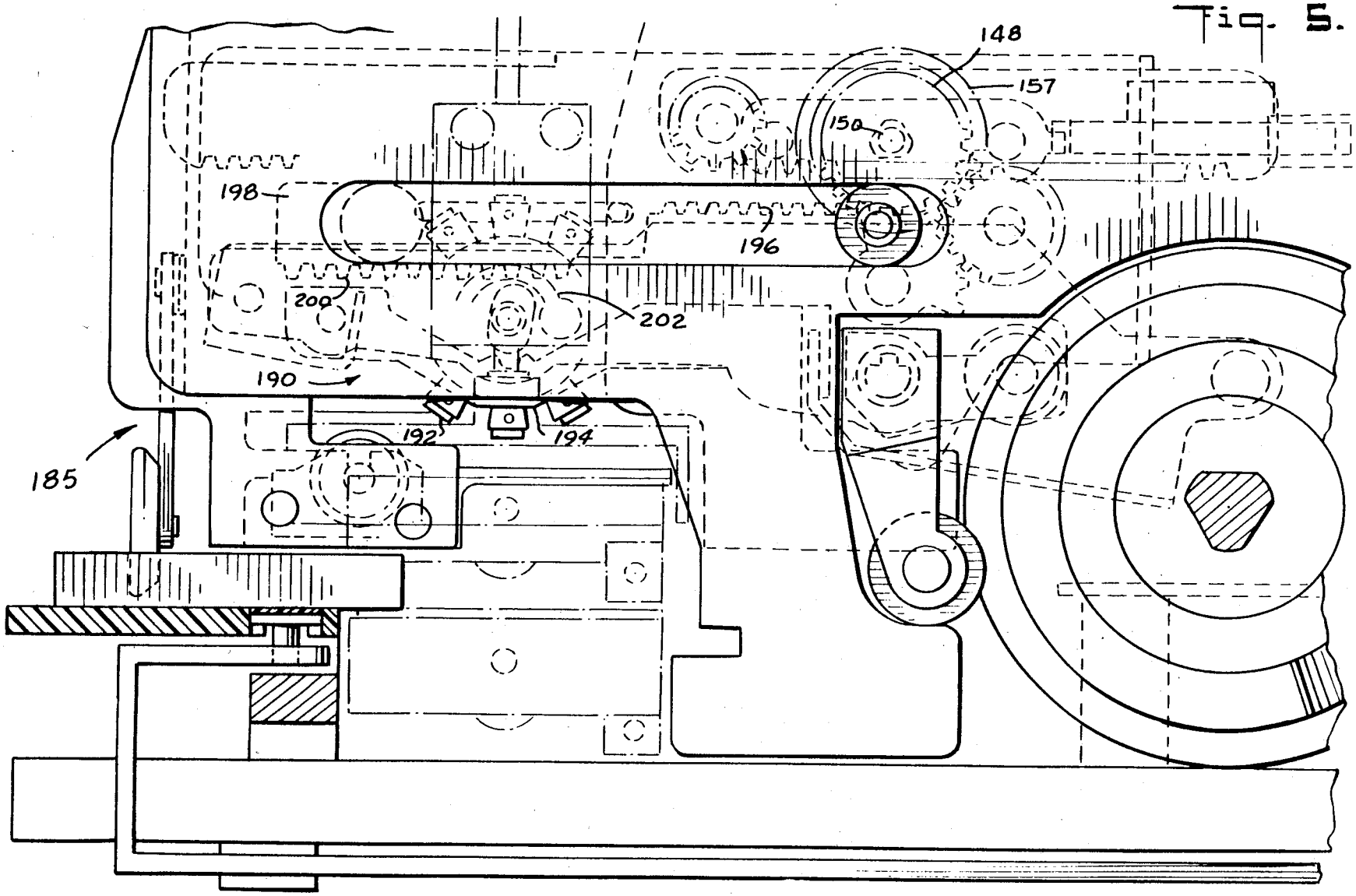
Figure 6A:
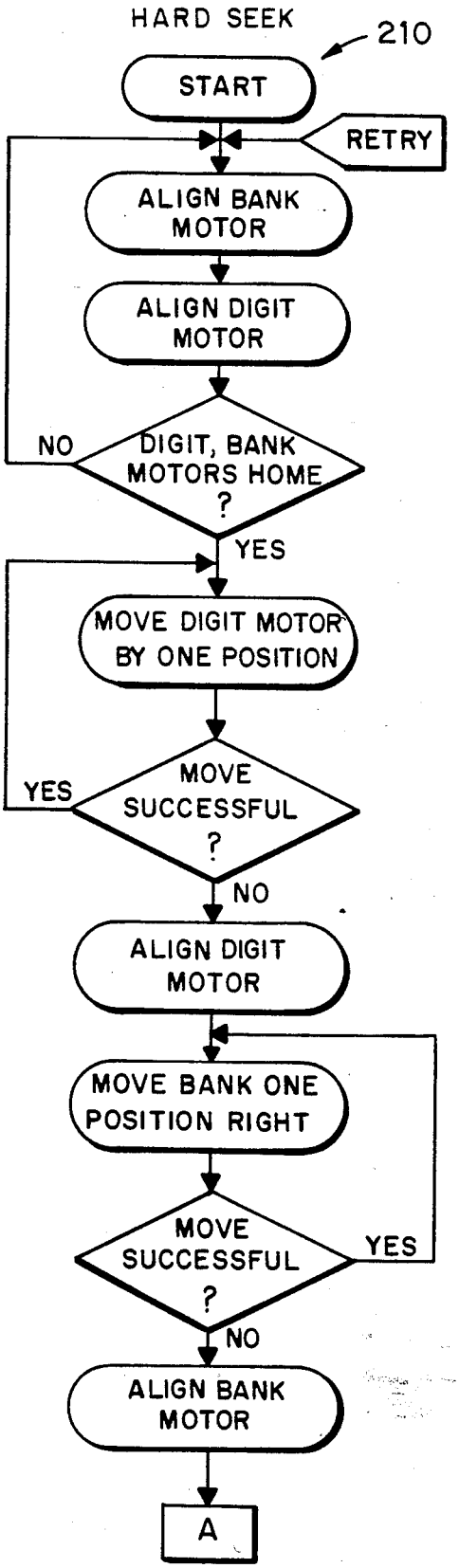
Figure 6B:
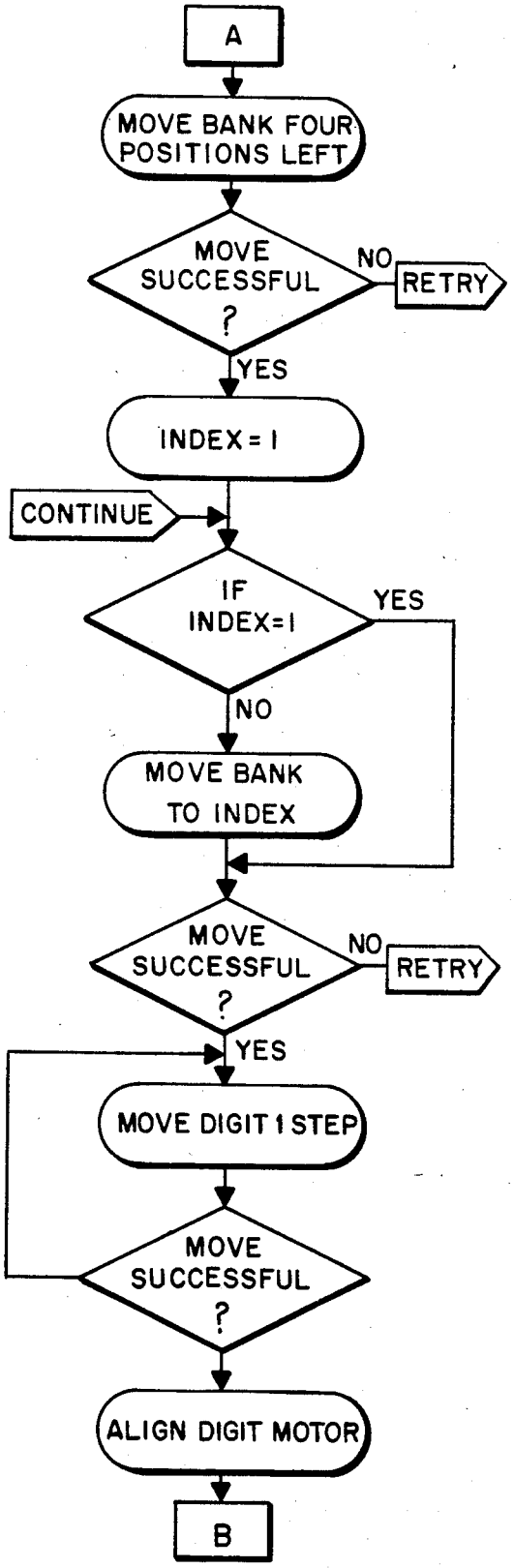
Figure 6C:
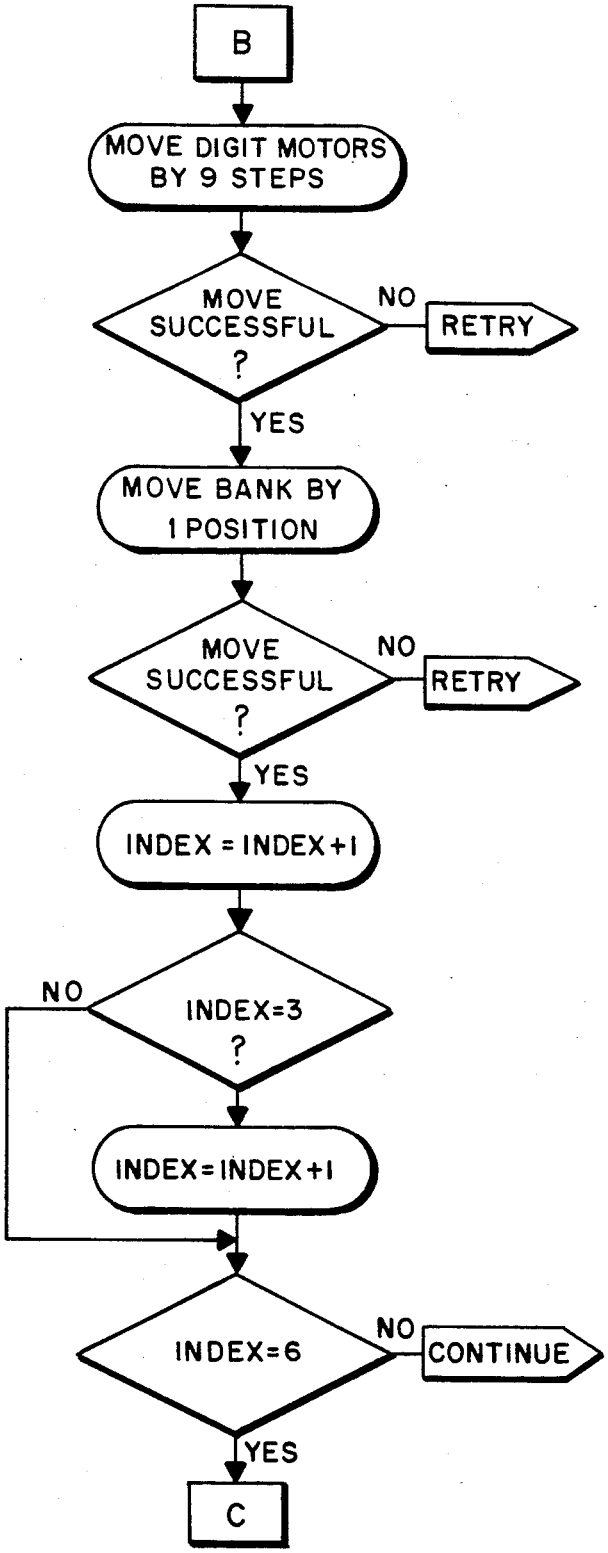
Figure 6D:
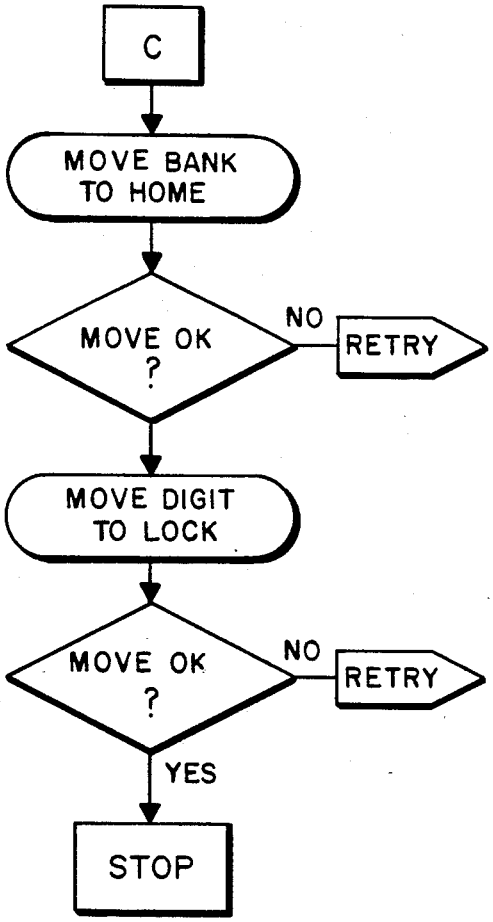
Figure 7A:
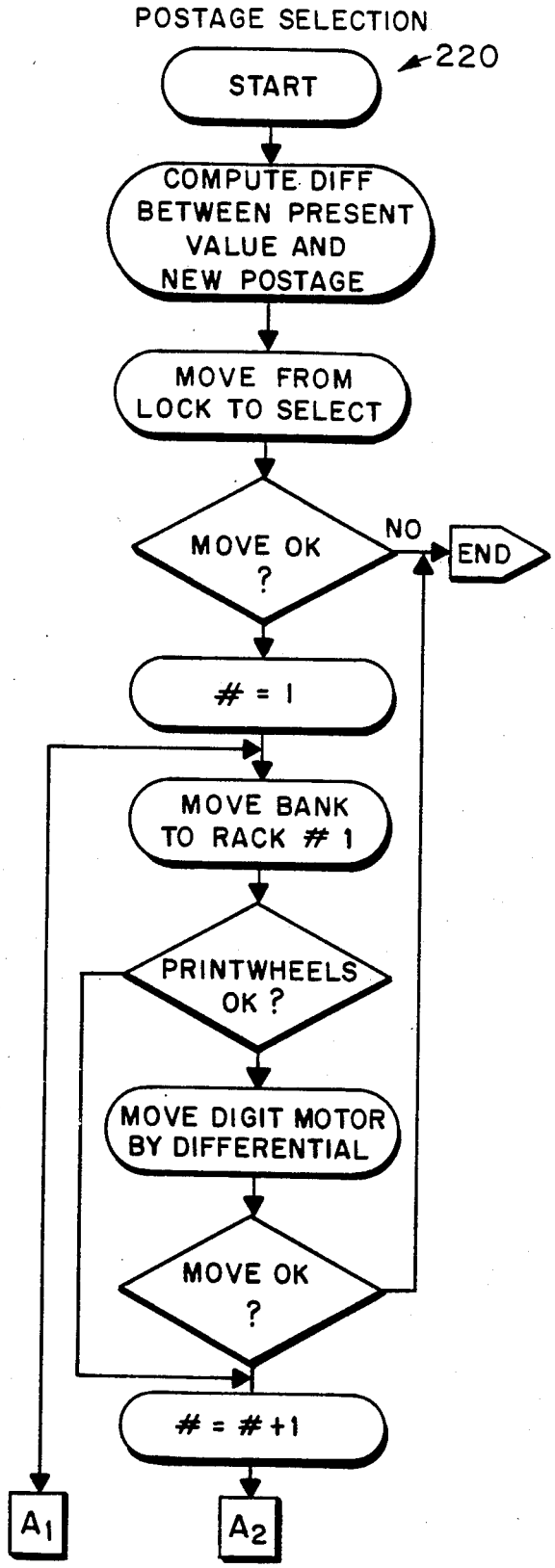
Figure 7B:
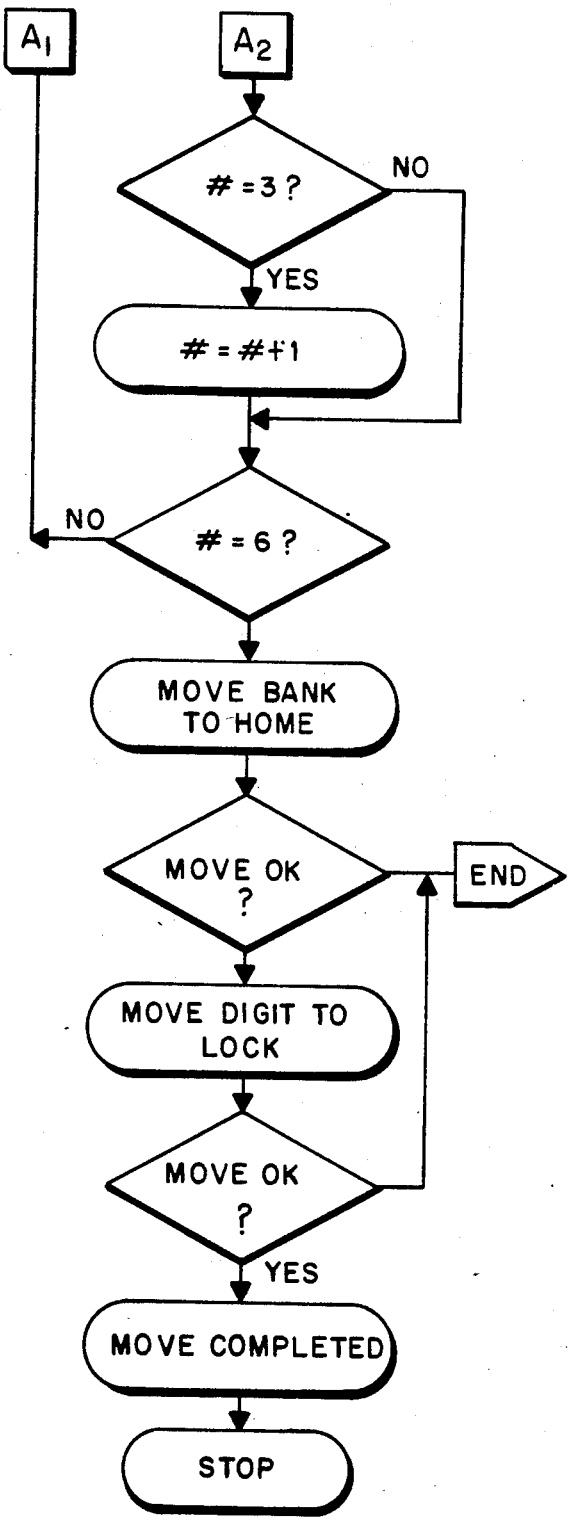

FIGS. *2a, 2b* are a detailed block diagram of an electronic circuitry for a stand-alone electronic postage meter;

FIG. 3 is a plan view of the print wheel selection mechanism for a postage meter utilizing the present invention;

FIG. 4 is a side elevation of the locking mechanism for the print wheels;

FIG. 5 is a detailed cross sectional view of the print wheel selection mechanism operative on a print wheel;

FIGS. *6a–6d* are a flow chart of a HARD SEEK Routine illustrating the present invention; and FIGS. *7a, 7b* are a flow chart of a Postage Selection Routine.

DETAILED DESCRIPTION

Figure 1:
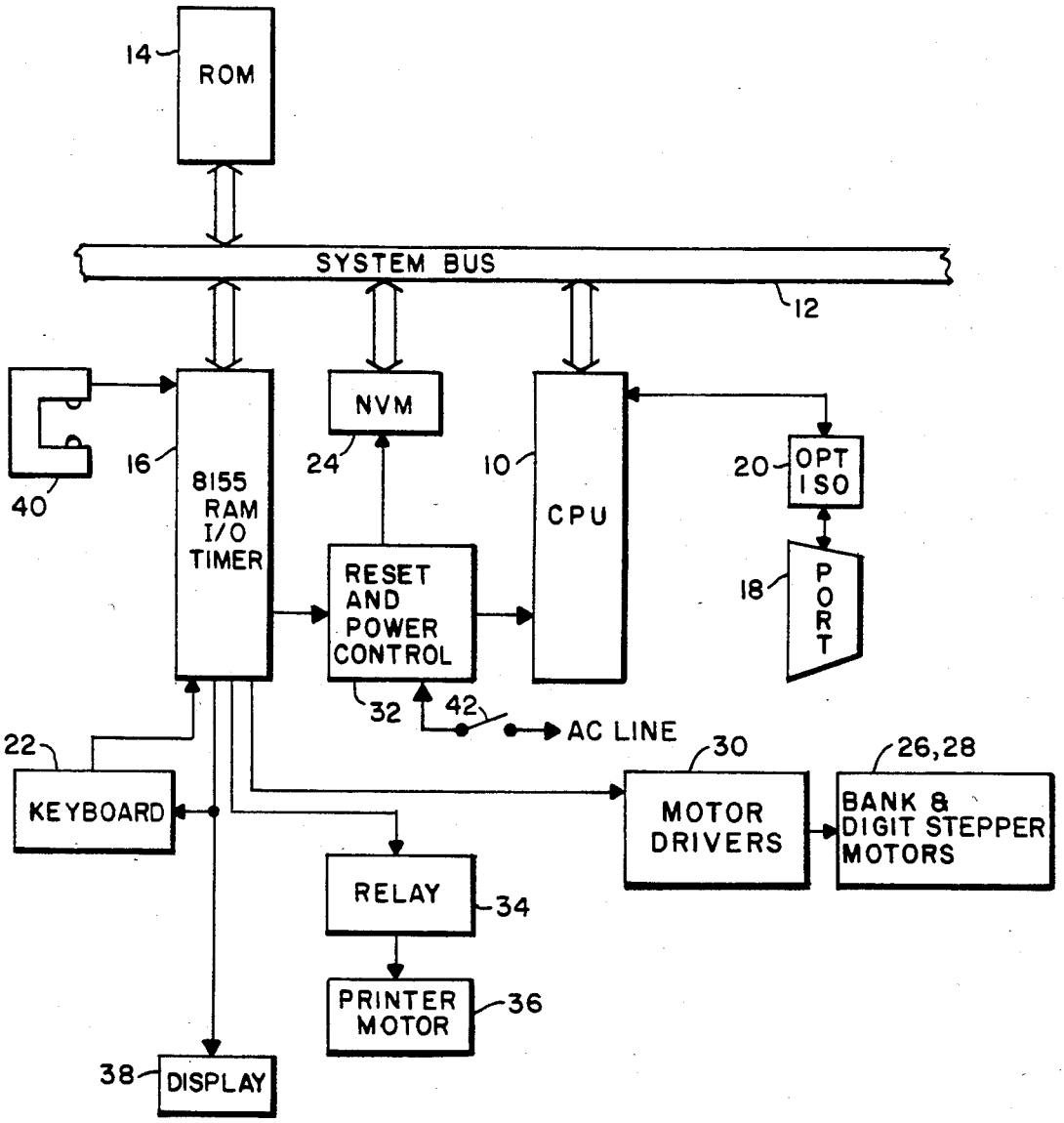
FIG. 1 is a block diagram of a general electronic circuit for a stand-alone electronic postage meter.

Referring to FIG. 1, the electronic postage meter includes an 8-bit microprocessor 10 (CPU), such as an Intel Model 8085A microprocessor which is connected to various components through a system bus 12. ROM 14 is connected to the microporcessor 10 through the system bus 12. The ROM 14 stores the programs for controlling the postage meter. It should be understood that the term ROM as used herein includes permanently programmed and reprogrammable devices.

An integrated circuit 16, which may be Intel Model 8155, is connected to the system bus 12 and includes RAM, input and output lines and a timer. The RAM portion of the integrated circuit 16 has memory space allocated for transient storage of the data for the ascending register and descending register. An external data communication port 18 is connected to the microprocessor 10 through optical isolator 20. The external data communication port 18 allows connection with devices such as an electronic scale, an external computer, servicing equipment and the like. Also electrically connected to the microprocessor 10 through the system bus 12 is the the keyboard 22 of the postage meter is connected to the integrated circuit 16 bia these I/O lines non-volatile memory (NVM) 24. Stepper motors 26, 28 are also in electrical connection with the microprocessor 10 via motor drivers 30 and the integrated circuit 16.

A reset and power control 32 is electrically connected between the integrated circuit 16, the NVM 24 and the microprocessor 10. A relay 34 connects the AC printer motor 36 to the integrated circuit 16. A display 38 is also electrically connected to the integrated circuit 16. Trip photosensor 40 is connected to the microprocessor 10 through integrated circuit 16 to indicate the presence of an envelope to be stamped, as described more fully in the aforementioned patent application entitled, STAND-ALONE ELECTRONIC MAILING MACHINE.

The electronic postage meter is controlled by the microprocessor 10 operating under control of the programs stored in the ROM 14. The microprocessor 10 accepts information entered via the keyboard 22 or via the external communication port 18 from external message generators. Critical accounting data and other important information is stored in the non-volatile memory 24. The non-volatile memory 24 may be an MNOS semiconductor type memory, a battery augmented CMOS memory, core memory, or other suitable non-volatile memory component. The non-volatile memory 24 stores critical postage meter data during periods when power is not applied to the postage meter.

This data includes in addition to the serial number of the mailing machine or postage meter information as to the value in the descending register (the amount of postage available for printing), the value in the ascending register (the total amount of postage printed by the meter), and the value in the piece count register (the total number of cycles the meter has performed), as well as other types of data, such as trip status, initialization and service information, which are desired to be retained in the memory even though no power is applied to the meter.

When an on/off power switch 42 is turned on (closed) a power supply internal to the mailing machine energizes the microprocessor 10 and the balance of the electronic components. The information stored in the non-volatile memory 24 is transferred via the microprocessor 10 to the RAM of the integrated circuit 16. After power up the RAM contains an image or copy of the information stored in the non-volatile memory 24 prior to energization. During operation of the postage meter, certain of the data in the RAM is modified. Accordingly, When postage is printed, the descending register will be reduced by the value of the printed postage, the ascending register increased by the value of the printed postage and the piece counter register incremented. When the power switch 42 is turned off (opened), the updated data in th RAM is transferred via the microprocessor 10 back into a suitably prepared area of the non-volatile memory 24. A like transfer of information between the non-volatile memory 24 and the RAM takes place during power failure.

Figure 2A:
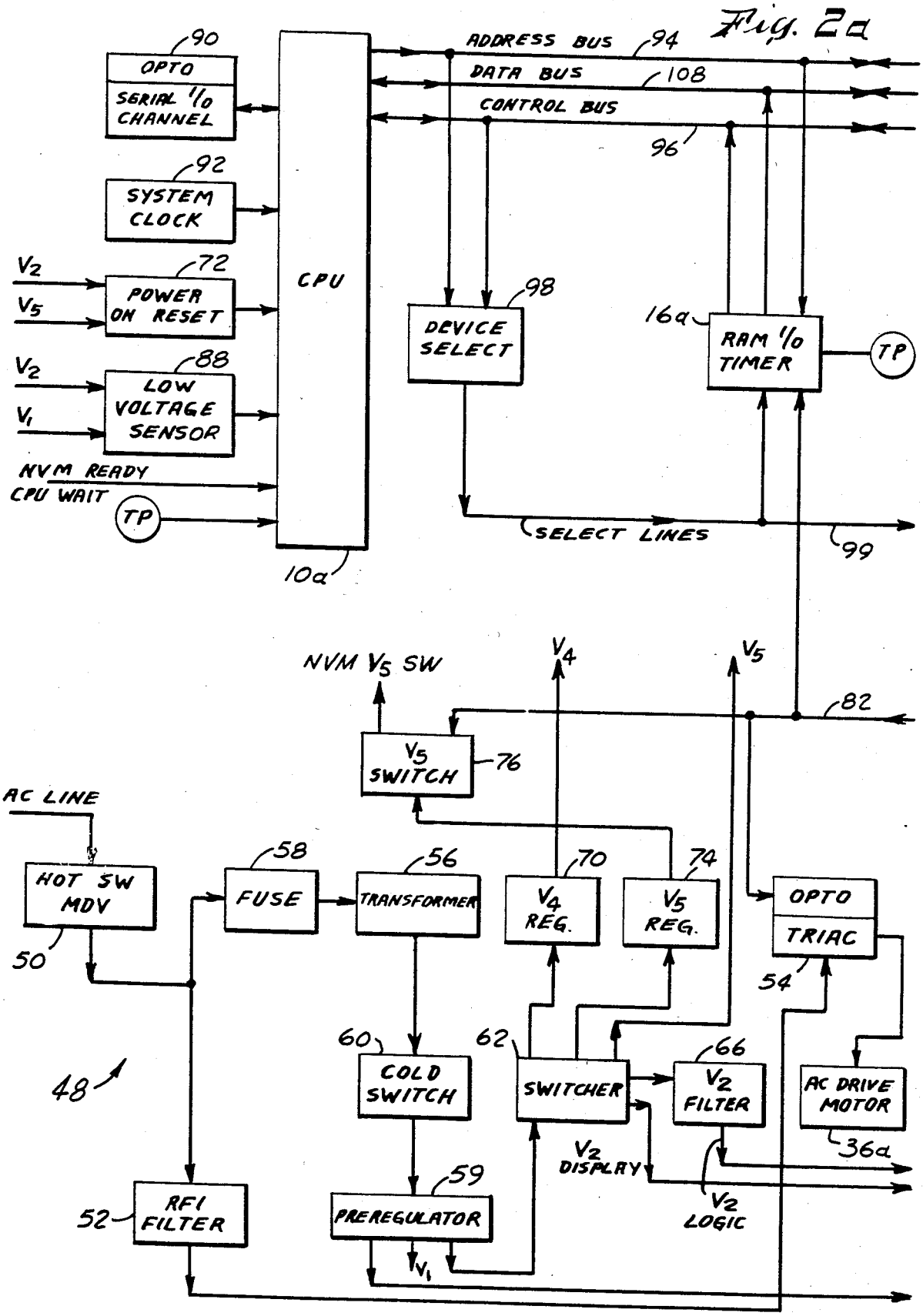

Referring to FIGS. 2*a*, 2*b* a more detailed block diagram of the arrangement of the electical components for the postage meter is illustrated generally as 48. Power is supplied to the postage meter from the AC line voltage, typically 115 volts. This line voltage is applied to the meter through a hot switch 50 which cuts off power to the postage meter to protect the electrical components thereof if the temperature rises above a preset limit, nominally 70 Degrees C. The hot switch 50 is connected to the AC drive motor 36*a* through an RF filter 52 and an opto-triac 54 which provides isolation between the line voltage and the control logic for the meter. The hot switch 50 is also connected to a transformer 56 protected by a fuse 58. The output of the transformer 56 is coupled to a pre-regulator 59 through a cold switch 60. The cold switch 60 cuts off power to th pre-regulator 59 if the temperature drops below a preset limit, nominally 0° C. The pre-regulator 59 provides an output voltage of a predetermined range to a switcher 62 which generates the output voltage +5 V; and the voltages for generating −12 V and −30 V.

The +5 V is applied to a +3 volt regulator 64 and then to the display 38*a*. The +5 V from the switcher 62 is also applied to a +5 V filter 66 which provides +5 V for loqic circuits.

Specifically, after passing through $V_2$ filter 66, the +5 V is applied to the keyboard 22*a*, the display 38*a*, and bank, digit and trip sensor logic 68 and to the integrated circuits. The −12 V is applied to a −12 V regulator 70 and then to the non-volatile memory 24*a*.

The −30 V output from the switcher 62 is also applied to a −30 V regulator 74 and then to a −30 V $V_5$ switch 76 which switches the output voltage on and off in response to the requirements of writing the NVM as dictated by the program. The output of the −30 V switch is applied to the non-volatile memory 24*a*. The −30 V supply is connected to the power on reset circuit 72 of the microprocessor 10*a*.

+5 V from the switcher 62 is also supplied to one input of the power on reset 72; the other input receives −30 V from the regulator 74 as previously described. A low voltage sensor 88 also receives one input of +5 V from the switcher 62 and its other input from the pre-regulator 59; its output is applied to the microprocessor 10*a*. The low voltage sensor 88 detects power failure and communicates this to the microprocessor 10*a* which in turn addresses the RAM through system bus 12*a* to transfer all security data present in the RAM to the non-volatile memory 24*a*.

Another output from the pre-regulator 59 in the form of +24 V is applied to the digit and bank motor drive 30*a* for the bank motor 26*a* and digit motor 28*a*, which selects the particular printing wheel (bank) which is to be activated and the particular digit of the selected printing wheel which is to be set.

An output strobe from the integrated circuit 16*a* is buffered through buffer driver 68 and applied to digit sensor (encoder) 78, bank sensor (encoder) 80, and trip sensor 40*a*. The opto strobe applies power to the digit sensor 78, bank sensor 80 and trip sensor 40*a* when needed. The output from the trip sensor 40*a* is applied to the input/output lines 82 which are coupled to the integrated circuit 16*a*. The outputs from the digit sensor 78 and bank sensor 80 and cycle switch 84 are applied to a storage buffer 86.

During power up, the key switch 42, see FIG. 1, is closed, and the AC line voltage energizes the electrical components previously described and an initialization process will occur. Such initialization may include a hard and/or soft initialization process as disclosed in the aforementioned U.S. Pat. No. 4,301,507.

In operation, the microproessor 10*a* under control of the ROM 14*a* and possibly the auxiliary ROM 100 communicates over the address bus 94 and control bus 96 with the device select 98. The output of the device select 98 communicates with the particular module to be addressed over select lines 99. The modules to be addressed are the RAM, the ROM 14*a*, an auxiliary ROM 100, a demultiplexer 102, NVM logic 104 and the buffer 86.

The RAM of integrated circuit 16*a* provides the working memory for the postage meter and the microprocessor 10*a*. The ROM 14*a* stores the program; the auxiliary ROM 100 may be used to provide additional program storage space. The non-volatile memory 24*a* provides storage of all security information for the meter and retains such information during power down or power failure.

The demultiplexer 102 latches the lower eight (8) bits of address information that defines a particular location which is used immediately thereafter. The NVM logic 104 controls the mode of operation of the NVM 24*a* and also provides ready wait and NVM ready signals to the microprocessor 10*a* to indicate the presence of the slow speed device (NVM) as active on the bus 12*a*.

As previously mentioned, the digital sensor 78 (optical encoder) and bank sensor 80, (optical encoder) and cycle switch 84 whose current state is read, i.e., "Home" or "In Cycle", apply input signals to the buffer 86 which sends output signals over data bus 108 to the microprocessor 10*a* for storage in the proper RAM location.

The RAM is also electrically coupled to I/O lines to transmit or receive data from the trip sensor 40*a*, the display 38*a*, keyboard 22*a*, and privilege access switch 110, if present. The privilege access switch 10 may be used in applications which require manual resetting of meter postage via a switch which is kept under seal.

Referring to FIGS. 3, 4 and 5, the print wheel selection mechanism for an electronic postage meter of the type disclosed in the aforementioned copending patent application entitled, STAND-ALONE ELECTRONIC MAILING MACHINE, is illustrated generally as 140, 182 and 185, respectively. Further details regarding the print wheel selection mechanism and the other mechanical components of such an electronic postage meter may be obtained from said aforementioned patent application, the disclosure of which is incorporated by reference as previously noted.

Referring to FIGS. 3 and 5, the print wheel selection mechanism 140 includes a trip lever 142 affixed to a rotatable trip shaft 144 adjacent to one end thereof for engagement and disengagement with a clutch 145. The trip shaft 144 also includes a gear 146, see FIG. 4, affixed thereto for engagement with and rotation by a gear 148 affixed to a tri-lobed shaft 150. A stepper motor 28*a* includes an output shaft 152 having a gear 154 and an optical encoder disk 156 (not to scale) mounted on the output shaft 152. The optical encoder disk 156 is received within a sensor 158 so that the position of the stepper motor shaft 152 can be determined. The gear 154 engages a gear 157 affixed to the tri-lobed shaft 150. The gear 148 is disposed within an opening of a carriage 160. The carriage 160 moves within the framework 180, along tri-lobed shaft 150. Another stepper motor 26*a* has a gear 168 mounted on its output shaft 170. An optical encoder disk 172 is also mounted on the output shaft 170 for determining the angular position of the gear 168 and output shaft 170. An optical sensor 174 receives the optical encoder disk 172 therein.

In operation, as seen in FIG. 3, the stepper motor 28*a* is energized to rotate the stepper motor gear 154 and the gear 157 affexed to the tri-lobed shaft 150. As seen in FIG. 4, rotation of the tri-lobed shaft 150 rotates gear 146 affixed to the trip shaft 144 which rotates a locking lever 162 affixed to the trip lever shaft 144 out of engagement with a carriage slot 164, thereby freeing the carriage 160 for movement along the tri-lobed shaft 150. As shown in FIGS. 3 and 4, the trip shaft 144 and trip lever 142 are in their home or middle position. The down position of the trip lever 142 is the set postage position. The up position of the trip lever 142 is the trip position. In the middle or intermediate position of the trip lever 142, as shown in FIG. 4, a locked condition exists. Rotation of the trip lever 142 to the down position disengages the locking lever 162 from the carriage slot 164 and allows movement to be imparted to the carriage 160 in either direction along the tri-lobed shaft 150 for selecting the appropriate bank or rack of the printing head 190, see also FIG. 5, in response to energization of bank stepper motor 26*a* which moves gear 166 via stepper motor gear 168.

Referring to FIGS. 3 and 5, the individual digit or font 192 of the desired print wheel 194 is then selected by the stepper motor 28*a* which rotates the tri-lobed shaft 150 and thus gear 148 which is engageable with the upper teeth 196 of a selected one of four print wheel racks 198. The gear 148 is engageable with the upper teeth 196 of one of the four racks 198 which racks 198 have lower teeth 200 on their opposite end. The lower teeth 200 of each of the racks 198 engage gears 202 that are integral with their respective print wheels 194. That is, there is a corresponding print wheel 194 and associated gear 202 for each of the four racks 198. The four print wheels 194 have fonts 192 distributed about their peripheries: each print wheel 194 having ten fonts 192 representing the digits 0 to 9.

As seen in FIG. 4, the trip lever 142 and carriage 160 are in the lock position. It should be understood, that hereinafter an initialization from a known position will be referred to as soft; and initialization from an unknown position will be referred to as hard. During hard Initialization, if the carriage 160 cannot be moved freely in a horizontal plane, the trip lever 142 is moved downwardly to its set postage or select position thereby freeing the locking lever 162 from the slot 164 to allow movement of the carriage 160.

Referring again to FIG. 3 the carriage 160, is then moved to the right to the limit of its range of movement until it abuts against framework 180. Two additional tries to move past this framework abutment 180 are made. The carriage 160, is then aligned with its last legitimate position by the optical encoder disk 172, sensor 174 and stepper motor 26*a*, and moved four (4) positions for alignment with the left most or first channel of racks 198.

Thereafter, the first print wheel 194 associated with the first rack 198 is set to zero. The carriage 160 is then moved one position to the right to the second channel of racks 198 and the second print wheel 194 associated there with is set to zero. This procedure is repeated sequentially with the third and fourth print wheels 194 until all the print wheels are aligned at the position 0000.

Before discussing the flow charts in FIGS. 6*a*–6*d* and 7*a*, 7*b*, it is believed helpful to make some general comments regarding the present invention. Briefly, a soft initialization of the type described in the aforementioned U.S. Pat. No. 4,301,507 occurs on each power up subsequent to the initial power up of the meter unless there was a power failure during postage selection, a power failure during soft initialization, or unforeseen binding of the meter components after which a hard initialization will occur. That is, a soft initialization will occur if the power was turned off in a stable state. Otherwise, a hard initialization will occur.

During the soft initialization process, the print wheels are individually exercised from their existing position until they all reach their maximum digit position, i.e., all 9s, and then rotated individually back to their minimum digit positions, i.e., all 0s. Optical encoder sensors indicate the position of the print wheels. Signals from these sensors are sent to the microprocessor for indicating on the display that the meter is now in condition for the new postage value to be selected, see FIGS. *7a, 7b.*

As previously stated, during the initial power up of the meter, after power failure, or after unforeseen binding of the meter components, a hard initialization will occur, i.e., the exact position of the print wheels 194 or the carriage 160 is unknown.

Three possible conditions exist. One, the gear 148 is meshing with gear 146, see FIG. 4. Therefore, the print wheel selection mechanism is in the select, lock and trip channel as shown in FIGS. 3 and 4. Two, the gear 148 is meshing with one of the racks 198, see FIG. 5. Three, the gear 148 is in between the racks 198.

If condition One exists, see FIGS. 3 and 4, the stepper motor 28*a* first rotates the gear 148 towards the select position, i.e., corresponding with the select position of the trip lever 142, one (1) increment or position at a time until it cannot rotate any farther. This fact is confirmed through a predetermined number of repetitive attempts, e.g., three times. The gear 148 is now aligned in the select position, confirmed by optical encoder disk 156 and sensor 158.

If condition Two exists, the digit stepper motor 28*a* first rotates the print wheel 194 associated with the rack 198 which is in mesh with gear 148 one (1) increment or position at a time until it abuts a stop beyond the maximum digit (cannot rotate any further). This is repeated three (3) times. The gear 148 is then now in alignment.

If condition Three exists, the interposer teeth 183, see FIG. 4, engage the racks 198 preventing rotation of the gear 148. The bank stepper motor 26*a* first moves the gear 148 to a rack 198 and then the digit stepper motor 28*a* rotates the print wheel 194 associated with that rack 198 as described with reference to condition Two.

We must now place the print wheels in a known position so we can thereafter set the print wheels to the desired postage value prior to commencing a DOTRIP Routine as disclosed in copending application Ser. No. 447,915, filed on even date herewith in the name of Edward C. Duwel entitled, MONITORING THE STATUS OF A TRIP CYCLE IN AN ELECTRONIC POSTAGE METER.

To accomplish this, the carriage 160 is moved in one direction (to the right in FIG. 3) by the bank motor 26*a* one (1) increment or position at a time until it reaches an obstruction. Two more attempts are made to move past the obstruction. It is then concluded that the carriage 160 of the print wheel selection mechanism is at one end of the limit of its range of movement, i.e., abutting framework 180. Sensor 174 then aligns the carriage 160 to its last legitimate unobstructed position. To verify this position, carriage 160 is then moved in a direction towards the other extreme position of the four (4) positions. The select and lock positions are in the middle channel and two sets of print wheels 194 are located on each side thereof for engagement with four racks 198, resulting in five (5) possible positions within the extremes of the range of movement of the print wheel selection mechanism. The only condition when the carriage 160 can move four positions in the direction towards the opposite extreme is if it is in the channel for the first print wheel.

However, it is not known where in this channel the print wheel selection for the digit motor is positioned, i.e., what digit is selected. Thereafter, the print wheel 192 under control of the digit motor 28*a* is moved one step or increment at a time to the upper limit in its range of movement until the movement fails after a total of three (3) attempts. The print wheel is then aligned with its last legitimate position by moving digit motor 28*a* slightly backward or forward. To confirm that the selection mechanism for the digit and bank motors is now in the nine position and to position it at the lowest digit, the motor rotates the print wheel nine (9) positions forward to its lowest digit to arrive at the position 0XXX. If it does not arrive at the position 0XXX, the entire process is repeated. The process is repeated a maximum of three times; if not successful, a fatal error bit is sent to the non-volatile memory 24*a*.

If the zero position is achieved in the first channel (extreme rack 198), the bank motor 26*a* then moves the carriage 160 one position to the right (position of second print wheel 194) and the digit motor 28*a* then moves the second print wheel 194 into engagement with its mechanical block or stop, aligns it at the last legitimate position (digit 9), then rotates it forward to establish the position 00XX as explained above. The bank motor 26*a* then moves the carriage 160 two positions to the right (skipping the select, lock and trip channel) and the digit motor 28*a* then moves the third print wheel 194 up into engagement with its mechanical block or stop, aligns it at the last legitimate position (digit 9) through rack 198 and then rotates it forward to establish the position 000X.

Finally, the bank motor 26*a* moves the carriage 160 one position to the right and then the digit motor 28*a* rotates the fourth print wheel up into engagement with its mechanical block or stop, aligns it at the last legitimate position (digit 9) and then rotates it nine (9) positions forward to establish the position 0000. The carriage 160 is then moved two channels to the left to arrive at the select channel and the digit motor 28*a* is moved a specified number of steps to position the trip lever 142 in the lock condition. A flag or bit is then sent to the working memory (RAM 16*a*) to indicate that the Hard Initialization process has been completed.

Referring to FIGS. *6a–6d*, the Hard Seek Routine for accomplishing the Hard Initialization is illustrated as 210. Initially the digit and bank motors 28*a* and 26*a*, respectively, are aligned to their home positions via digit and bank motor sensors 158 and 174, respectively. Thereafter, to accommodate conditions One, Two or Three previously described, the digit stepper motor 28*a* rotates the gear 148 one position at a time until a stop is encountered.

This is repeated two more times. The digit motor 28*a* is then aligned to its last legitimate position. The bank stepper motor 26*a* then moves the gear 148 and carriage 160 one position to the right, see FIG. 3. Movement of the carriage 160 is continued until the stop 180 is encountered. Two more attempts are made to move past the stop 180. When an abutment occurs this is repeated two (2) more times; then the digit motor 28*a* is aligned to its last legitimate position. It is now concluded that the carriage 160 is at its extreme range of movement.

The bank motor 26*a* is then aligned to its last legitimate position. The carriage 160 is then moved four (4) positions to the left.

If the move is successful, the index or channel position is then set at one (1). If unsuccessful, the process starts over. If the move is successful, the print wheel 194 is moved (1) position towards its maximum digit. If that move is successful, movement of the print wheel 194 is further continued until a mechanical abutment occurs. Three attempts are made to move past the abutment. It is then concluded that the print wheel 194 is at its extreme range of movement. Thereafter, the digit motor 28*a* is aligned to its last legitimate position. The print wheel 194 is then rotated nine (9) positions to its zero digit. If the move is not successful, RETRY is executed. If the move is successful, the carriage 160 is moved one position to the left to the next channel or rack. If the move is not successful, RETRY is executed. With a successful move, the index is changed by one. When the index becomes equal to three (3) (select, lock and trip channel position), this position is skipped and the index is changed by one. With the index equal to four (4) and five (5), the positions of the third and fourth racks or channels, respectively, the same procedures are repeated as with the first and second print wheels. When the index becomes equal to six (6), the carriage 160 is moved to home, i.e., select lock and trip channel. If the move to home is okay, the digit motor 28*a* moves the trip lever 142 to the lock position. If this move is okay, the Routine stops. If this move is not okay, RETRY is executed.

The alignment provided by the hard initialization of the present invention permits assembly of the postage meter with adjustments being done on the fly as required. This eliminates the need to make precise adjustments of the stepper motors, sensors and encoder disks during manufacture with an attendant reduction in manufacturing costs. Moreover, the digit motor 28*a* achieves precise positioning by utilizing a six (6) incremental movement for each digit in contrast with prior initialization techniques such as those disclosed in the aforementioned U.S. Pat. No. 4,301,507, which utilized a four (4) step incremental movement for each digit.

Referring to FIGS. *7a, 7b,* after completion of the Hard Initialization process in FIGS. *6a–6d,* the Postage Selection Routine illustrated as 220 may be implemented. This routine begins with a computation between the present value at which the print wheels are set, and the new postage value. The trip lever 142 and carriage 160 is then moved from the lock to the select position. If the move is not okay, a fatal error is logged in non-volatile memory and the routine is ended. If the move is okay, the channel position (rack) is set at one (1). The carriage 160 is then moved to the position of the first rack. If the setting of the print wheels 194 at each rack 198 is okay, the channel position (rack) is then changed by one (1). When the channel number (rack) is equal to six (6), the carriage 160 is moved home. If the setting of the print wheels 194 at each rack 198 is not okay, the digit motor is energized to rotate the print wheel 194 to make up the differential. If the movement of each print wheel 194 is okay, the channel position is incremented by one (1); channel three (3) is skipped. If the movement caused by the digit motor 28*a* or bank motor 26*a* is not okay, a fatal error is logged in non-volatile memory 24*a* and the routine is ended.

Advantageously, the algorithm underlying the program set forth in the Program Appendix provides increased power to the bank motor 26*a* and digit motor 28*a* when an unforeseen mechanical obstruction or bind is encountered. Normally, the bank motor 26*a* and digit motor 28*a,* both of which include four windings, have only one (1) of their windings energized and operate as a single phase drive. When an obstruction is encountered, i.e., the bank motor 26*a* or digit motor 28*a* is mechanically bound, additional power is applied to the desired motor 26*a* or 28*a* by energizing a second winding, using a two phase drive for the subsequent attempts to move past the obstruction. After the obstruction has been overcome, i.e., the digit motor 28*a* or bank motor 26*a* can be aligned, the algorithm deenergizes the second winding of the motor 28*a* or 26*a* and the respective motor 28*a* or 26*a* shifts back to a single phase drive. This conserves power and minimizes the effect of increasing the power on the electrical components. It should also be understood that power to the motors 26*a* or 28*a* may be increased prior to encountering a stop. That is, in anticipation of a stop.

Further, on those occasions when it is anticipated that a stop limit will be encountered, the algorithm can cause the torque of the motors 26*a* or 28*a* to increase by reducing the stepping rate of the motors 26*a* or 28*a.* The reduction in the stepping rate allows more time for current build up in the windings of the motors 26*a* or 28*a* to increase the torque and overcome any possible resistance by stress imparted to the mechanical components due to aging. Specifically, in moving the trip lever 142 from the lock position to the trip position, the stepping rate of the digital motor 28*a* is reduced since the digital motor 28*a* must drive the trip lever 142 to the trip position to enable the drive mechanism for printing postage on an envelope. It should also be understood that both the power and torque to the motors 26*a* and 28*a* may be increased as described above.

It is known and understood for the purpose of the present application that the term postage meter refers to the general class of device for the imprinting of a defined unit value for governmental or private carrier delivery of parcels, envelopes or other like application for unit value printing. Thus, although the term postage meter is utilized, it is both known and employed in the trade as a general term for devices utilized in conjunction with services other than those exclusively employed by governmental postage and tax services. For example, private, parcel and freight services purchase and employ such meters as a means to provide unit value printing and accounting for individual parcels.

It should be apparent to those skilled in the art that various modifications may be made in the present invention without departing from the spirit and scope thereof as described in the specification and defined in the appended claims.

What is claimed is:

1. A method for initializing the print wheels of an electronic postage meter, comprising the steps of:

placing a lever of a print wheel selection mechanism in its select position;

moving a carriage of the print wheel selection mechanism into abutment with a stop a plurality of times;

aligning the carriage with a plurality of racks of the selection mechanism;

orienting one of the plurality of racks with a predetermined one of the print wheels;

rotating the print wheel to the limit of its movement a plurality of times;

aligning the print wheel;

exercising the print wheel to set it at a predetermined position;

continuing the moving, aligning, orienting, and exercising steps sequentially with each print wheel to set all the print wheels to a predetermined position; and outputting a signal when the foregoing steps have all been accomplished.

2. The method recited in claim 1, including the step of:

increasing the force by which the carriage of print wheel selection mechanism is moved into abutment with the stop to a greater value than the force normally applied to the carriage.

3. The method recited in claim 1, wherein:

the alignment of the carriage and print wheel provides adjustments on a fly as needed.

4. The method recited in claim 1, including the step of:

increasing the force by which the print wheel is rotated to the limit of its movement to a greater value than the force normally applied to the print wheel.

5. the method recited in claim 1, including the steps of:

increasing the force by which the carriage of the print wheel selection mechanism is moved into abutment with the stop to a greater value than the force normally applied to the print wheel selection mechanism; and increasing the force by which the print wheel is rotated to the limit of its movement to a greater value than the force normally applied to the print wheel.

6. A method for initializing the print wheels of an electronic postage meter, comprising the steps of:

placing a lever of a print wheel selection mechanism in its select position;

moving a carriage of the print wheel selection mechanism to the limit of its movement in one direction a plurality of times;

moving a first rack of a plurality of racks of the print wheel selection mechanism to its last legitimate position;

verifying that the first rack of the print wheel selection mechanism is operative on a predetermined printing wheel by moving the rack in one direction a given number of positions;

rotating the predetermined print wheel to the limit of its movement in one direction a plurality of times;

moving the print wheel to its last legitimate position; and rotating the print wheel in one direction a given number of positions to a predetermined position.

7. The method recited in claim 6, including the steps of:

moving a second rack into orientation with a second print wheel; and repeating the steps of rotating, moving and rotating the print wheel to set this print wheel to a predetermined position.

8. The method recited in claim 7, including the steps of:

moving a third rack into orientation with a third print wheel; and repeating the steps of rotating, moving and rotating the print wheel to set this print wheel to a predetermined position.

9. The method recited in claim 8, including the steps of:

moving a fourth rack into orientation with a fourth print wheel; and repeating the steps of rotating, moving and rotating the print wheel to set this print wheel to a predetermined position.

10. the method recited in claim 9, including the steps of:

placing the first, second, third and fourth racks and carriage in a locked position when all the print wheels have been set to a predetermined position; and transmitting a signal indicating that all of the print wheels have been initialized to a predetermined position.

11. The method recited in claim 6, wherein:

the movements to the last legitimate position provide adjustments on a fly as needed.

12. The method recited in claim 6, including the step of:

increasing the force by which the carriage is moved into abutment with a stop during subsequent movements to a greater value than the force applied to the print wheel selection mechanism during the first movement into abutment with the stop.

13. The method recited in claim 6, including the step of:

increasing the force by which the print wheel is rotated to the limit of its movement during subsequent rotations to a greater value than the force applied to the print wheel during the first rotation into abutment with a stop.

14. The method recited in claim 6, including the steps of:

increasing the force by which the carriage is moved into abutment with a stop during subsequent movements to a greater value than the force applied to the print wheel selection mechanism during the first movement into abutment with a stop; and increasing the force by which the print wheel is rotated to the limit of its movement during subsequent rotations to a greater value than the force applied to the print wheel during the first rotation to the limit of its movement.

15. Apparatus for initializing the print wheels of an electronic postage meter, comprising:

print wheel selection means including an integral carriage assembly and a plurality of rack members;

means for placing the print wheel selection means in its select position;

means for moving the carriage assembly into abutment with a stop a plurality of times;

means for aligning the carriage assembly with the plurality of racks;

means for orienting the first rack with a predetermined one of the print wheels;

means for moving a print wheel the limit of its movement a plurality of times;

means for aligning the print wheel;

means for exercising the print wheel to set it at a predetermined position;

the moving means, aligning means, orienting means and exercising means sequentially acting upon the remaining print wheels to set all the print wheels to a predetermined position; and means for outputting a signal when all the print wheels have been initialized to a predetermined position.

16. The apparatus recited in claim 15, wherein:

the means for moving the carriage assembly means includes a stepper motor; and means for increasing the power applied to the stepper motor prior to abutment with the stop.

17. The apparatus recited in claim 15, wherein:

the means for aligning the carriage assembly with the plurality of racks and the print wheel provides adjustments thereto on a fly as needed.

18. The apparatus recited in claim 15, wherein:

the means for moving the print wheels includes a stepper motor;

means for increasing the power applied to the stepper motor prior to abutment with a stop.

19. The apparatus recited in claim 15, wherein:

the means for moving the carriage assembly means includes a stepper motor; and means for increasing the power applied to the stepper motor prior to abutment with the stop;

the means for moving the print wheels includes a stepper motor;

means for increasing the power applied to the stepper motor prior to abutment with a stop.

20. Apparatus for initializing the print wheels of an electronic postage meter, comprising:

print wheel selection means including a carriage assembly and a plurality of racks;

means for moving the carriage assembly to the limit of its movement in one direction a plurality of times;

means for moving a first rack to its last legitimate position;

means for verifying that first rack is operative on a predetermined print wheel by moving the rack in one direction a given number of positions;

means for rotating the predetermined print wheel to the limit of its movement in one direction a plurality of times and then to its last legitimate position; and the means for rotating the predetermined print wheel then moving the predetermined print wheel in one direction a given number of positions to reach a predetermined position.

21. The apparatus recited in claim 20, wherein:

the means for moving the carriage assembly includes a stepper motor; and means for increasing the power applied to the stepper motor in response to the initial abutment with a stop.

22. The apparatus recited in claim 20, wherein:

the means for rotating the print wheel includes a stepper motor; and means for increasing the power applied to the stepper motor in response to the initial abutment with a stop.

23. The apparatus recited in claim 20, wherein:

the means for moving the carriage assembly includes a stepper motor; and means for increasing the power applied to the stepper motor in response to the initial abutment with a stop;

the means for rotating the print wheel includes a stepping motor; and means for increasing th power applied to the stepper motor in response to the initial abutment with a stop.

24. The apparatus recited in claim 20, wherein:

the means for moving the first rack to its last legitimate position and the means for rotating the predetermined print wheel to its last legitimate position provide for adjustments to the print wheel selection means and the print wheel on a fly as needed.

25. The apparatus recited in claim 20, wherein:

the means for moving the plurality of racks moves a second rack into orientation with a second print wheel;

the means for rotating the predetermined print wheel rotates the second print wheel to the limit of its movement in one direction a plurality of times and then to the last legitimate position; and the means for rotating the predetermined print wheel then rotating the second print wheel in one direction a given number of positions to reach a predetermined position.

26. The apparatus recited in claim 25, wherein:

the means for moving the plurality of racks moves a third rack into orientation with a third print wheel;

the means for rotating the predetermined print wheel rotating the third print wheel to the limit of its movement in one direction a plurality of times and then to the last legitimate position; and the means for rotating the predetermined print wheel then rotating the third print wheel in one direction a given number of positions to reach a predetermined position.

27. The apparatus recited in claim 26, wherein:

the means for moving the plurality of racks moves a fourth rack into orientation with a fourth print wheel;

the means for rotating the predetermined print wheel rotating the fourth print wheel to the limit of its movement in one direction a plurality of times and then to the last legitimate position; and the means for rotating the predetermined print wheel then rotating the fourth print wheel in one direction a given number of positions to reach a predetermined position.

28. The apparatus recited in claim 27, comprising:

means for placing the first, second, third and fourth racks and carriage in a locked position; and means for transmitting a signal indicating that the initialization process has been completed.

29. The apparatus recited in claim 20, wherein:

the means for moving the carriage assembly includes a stepper motor having a plurality of windings; and means for increasing the power applied to the stepper motor by energizing more than one winding of the stepper motor.

30. The apparatus recited in claim 20, wherein:

the means for rotating the print wheel includes a stepper motor having a plurality of windings; and means for increasing the power applied to the stepper motor by energizing more than one winding of the stepper motor.

31. The apparatus recited in claim 20, wherein:

the means for moving the carriage assembly includes a stepper motor; and means for increasing the torque of the stepper motor by reducing the stepping rate.

32. The apparatus recited in claim 20, wherein:

the means for rotating the print wheel includes a stepper motor; and means for increasing the torque of the stepper motor by reducing the stepping rate.

* * * * *